US012312880B2

(12) United States Patent
Teixeira Da Gama Lima et al.

(10) Patent No.: US 12,312,880 B2
(45) Date of Patent: May 27, 2025

(54) PULL-IN SYSTEM AND METHOD OF KEELHAULING RIGID RISERS USING A DEFLECTOR DEVICE AND DOUBLE LAYER SUPPORT TUBE

(71) Applicant: PETRÓLEO BRASILEIRO S.A.-PETROBRAS, Rio de Janeiro (BR)

(72) Inventors: Jose Mauricio Teixeira Da Gama Lima, Rio de Janeiro (BR); Pedro Luiz Ferreira Mendes, Rio de Janeiro (BR); Jose Abreu E Silva Filho, Macaé (BR); Flavio Barroso De Mello, Rio de Janeiro (BR); Ricardo Pires Mendes Peixoto, Rio de Janeiro (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 18/480,399

(22) Filed: Oct. 3, 2023

(65) Prior Publication Data

US 2024/0117689 A1 Apr. 11, 2024

(30) Foreign Application Priority Data

Oct. 6, 2022 (BR) ..... 10 2022 020272 9

(51) Int. Cl.
*E21B 19/00* (2006.01)
*E21B 17/01* (2006.01)

(52) U.S. Cl.
CPC ..... *E21B 19/004* (2013.01); *E21B 17/01* (2013.01)

(58) Field of Classification Search
None
See application file for complete search history.

(56) References Cited

U.S. PATENT DOCUMENTS 5,269,629 A * 12/1993 Langner ..... E21B 19/004 405/195.1
5,447,392 A * 9/1995 Marshall ..... E21B 17/01 405/224.4

(Continued)

FOREIGN PATENT DOCUMENTS

AU 2014397727 B2 3/2019
BR PI1003096 4/2012

(Continued)

*Primary Examiner* — Matthew R Buck
*Assistant Examiner* — Douglas S Wood
(74) *Attorney, Agent, or Firm* — Knobbe Martens Olson & Bear LLP

(57) ABSTRACT

The present invention pertains to the technical field of oil and gas; more specifically to the field of risers and flow line connections to offshore structures, and describes a pull-in cable deflector system in keelhauling of rigid risers comprising: a deflector assembly including a deflector device housed in a structural block, a sliding structure, at least two rails. The deflector device installed in the structural block is moved through a sliding structure on rails installed forward of the URB to the different pull-in or pull-out positions in keelhauling of rigid risers. The structural block is slidably mounted on a base frame by means of a system of sliding supports to perform a first adjustment of the transverse distance from the deflector device to the URB. The deflector device is then rotated around the vertical line depending on the azimuth of the support tube. A second adjustment of the transverse distance of the deflector device is performed during the pull-in operation.

20 Claims, 10 Drawing Sheets

(56) References Cited

U.S. PATENT DOCUMENTS

| | | | | |
|---|---|---|---|---|
| 7,416,025 | B2 * | 8/2008 | Bhat | E21B 17/012 405/224.4 |
| 7,472,755 | B2 * | 1/2009 | Riggs | E21B 43/0107 166/359 |
| 7,669,660 | B1 * | 3/2010 | Murray | E21B 17/015 166/344 |
| 10,309,161 | B2 | 6/2019 | De Barros et al. | |
| 10,597,952 | B2 | 3/2020 | Otten et al. | |
| 2012/0247579 | A1 | 10/2012 | Park et al. | |
| 2018/0347135 | A1 * | 12/2018 | Kannegaard | E21B 19/002 |
| 2021/0317709 | A1 | 10/2021 | Hogan et al. | |
| 2022/0316285 | A1 * | 10/2022 | Simões | E21B 43/0107 |
| 2024/0044423 | A1 | 2/2024 | Fiorenza de Lima et al. | |

FOREIGN PATENT DOCUMENTS

| | | | |
|---|---|---|---|
| BR | 102014031802 | | 6/2016 |
| BR | 102017018210 | | 3/2019 |
| CA | 2802902 | C | 12/2016 |
| GB | 2522440 | A | 7/2015 |
| JP | S57-102441 | A | 6/1982 |
| WO | WO 12/056132 | | 5/2012 |
| WO | WO 21/048592 | | 3/2021 |

* cited by examiner

PULL-IN SYSTEM AND METHOD OF KEELHAULING RIGID RISERS USING A DEFLECTOR DEVICE AND DOUBLE LAYER SUPPORT TUBE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. This application claims the benefit of Brazilian Application No. BR 10 2022 020272 9, filed Oct. 6, 2022, the entire contents of which are hereby incorporated by reference.

FIELD OF THE INVENTION

The present invention pertains to the technical field of oil and gas; more specifically to the field of risers, and flow line connections to offshore structures. More specifically, the present invention relates to a system and method for attaching risers to FPSOs (Floating, Production, Storage and Offloading).

BACKGROUNDS OF THE INVENTION

Line pulling in techniques and operations, better known as "pull-in", are of paramount importance in the offshore oil industry. These techniques include a set of surface maneuvers on board a Stationary Production Unit (SPU), to make it possible to transfer a pipe or riser, to be interconnected to the platform, through connection and fixing operations. The operations to disconnect lines or risers are known as "pull-out".

Particularly in relation to FPSOs, it should be noted that such units often present physical limitations to rigid riser pull-in operations when these are carried out using the keelhauling method; that is, when the lifting or transfer of a riser or equipment is carried out below the floats of a semi-submersible platform or ship; such as, for example, lifting under the keel of a vessel.

One of these limitations is related to the failure to comply with the clearance requirements for the maneuvers necessary to install and fix the rigid risers in their submerged conical receptacles located on the Lower Riser Balcony (LRB) of the FPSO. In this type of support, it must be ensured that the pull-in cable and the rigging equipment used in the pull-in can move freely during the pull-in of the rigid riser at a second end, without interference with the LRB structures and that, especially in the final step of the pull-in operation, the top joint of the riser (flexible joint—FXJ, titanium stress joint—TSJ, among others) maintains a minimum horizontal clearance to the receptacle, which allows it to be suspended and placed on this support using the auxiliary pull-in system located on the lower balcony.

It is remarkable that the receptacle connection method makes the pull-in operation by lifting under the FPSO (keelhauling) difficult, even more so in situations where the lower riser balcony has a double-layer configuration.

Some solutions to meet the mentioned clearance conditions, in order to promote the connection of rigid risers to receptacles arranged on the balcony, involve major modifications to the FPSO structures, which ends up demanding time and increasing the costs involved in the operation.

One of the alternatives found consists of adopting, in keelhauling positions, special support systems (hang-off) in support tubes arranged in the internal layer of the LRB that will allow direct pull-in through a guide tube of rigid risers, without the use of an auxiliary system. These special support systems are composed of a special support tube with resident locking mechanisms and a rigid riser interface component (integrated into its butt joint) with the support tube (Hang-off Adapter—HOA).

However, although this solution with a support tube in the internal layer (first layer) of the LRB has made it viable to pull-in rigid risers through keelhauling operations, it practically excludes the possibility of using flexible risers as an alternative to rigid risers in respective interconnections. This is because the new support tubes now occupy the place that would have been reserved for the lower I-Tubes for connecting bell mouths, responsible for coupling the bend stiffener of the flexible riser. It is worth highlighting that I-Tubes, tubular structures generally mounted on the sides of FPSOs, are the standard interface systems for receiving flexible risers in the production units. These have a small angular deviation that is easily accommodated for flexible risers, but do not allow rigid risers to pass inside the same.

Although the modular design of the support tube allows recovery or modification for its eventual conversion into a lower I-Tube for a flexible riser, this adaptation requires great mobilization of the shallow dip front, considerably increasing risks and operating costs.

Furthermore, the simple adoption of the pull-in method in support tube does not eliminate all restrictions of current FPSO designs on the keelhauling operation of rigid risers, since the pull-in cable will generally not be aligned with the orientation of the support tube, therefore persisting interferences that will entail additional risks and costs.

Therefore, there is a need to develop a system and method for connecting rigid risers to FPSO units during pull-in in keelhauling operations that overcomes the above problems, without having to make major modifications to the FPSO structure, or in the riser connection structures, and that allows the pull-in of both rigid risers and flexible risers.

Thus, in order to solve the aforementioned limitations, the present invention aims at providing a system and method of pull-in in keelhauling of rigid risers using a deflector device for the main pull-in cable and support tube on a layered balcony pair.

In this way, the present invention makes it possible, without operational losses, to move rigid risers in FPSOs during their installation by keelhauling operations, promoting the centralization of the main pull-in cable with the orientation of the Support Tube, minimizing contact with sliding, in addition to allowing a second layer arrangement of the Support Tube in the LRB, thus allowing the maintenance of I-Tubes and Bell Mouths for alternative connection of flexible risers in the respective pipe applications. In this way, the intended system would circumvent, in different FPSO models, the limitations to keelhauling operation still present in FPSO projects today.

STATE OF THE ART

Document WO 2021/048592 A1 describes a system and method for connecting an offshore riser pipe to an FPSO, which improves the alignment between the pull-in cable, the upper end of the riser, and the I-tube during approach and insertion of the end of the riser into the I-tube. Furthermore, the aforementioned document proposes a system and method for connecting an offshore riser pipe to a floating unit FPSO, which allows reducing the number of additional pull-in cable redirection sheaves/pulleys between the I-tubes and the winches, and the cost and installation time for such redirection sheaves. However, document WO 2021/048592 A1 fails to disclose or suggest a structure positioned on the upper riser balcony to facilitate better lateral and angular adjustment of the pull-in cables. Furthermore, the aforementioned document does not propose an adaptation for the double-layer LRB to use rigid and/or flexible risers, depending on the application.

Additionally, document US 2021/00317709 A1 discloses a rigid riser adapter operable to be installed at least partially in an LRB. The rigid riser adapter includes a receptacle support structure. Furthermore, the adapter also includes an adapter tube extending from the receptacle support structure along a vertical direction, the adapter tube operable to be inserted through the LRB. Further, the adapter may also include a rigid riser receptacle coupled to the receptacle support structure, wherein the rigid riser receptacle is inclined between six degrees and twenty degrees relative to the vertical direction. However, the aforementioned document fails to disclose a deflector assembly positioned on the upper riser balcony, as well as a system that allows adaptation to different coupling positions and adjustment in pull-in operations.

In turn, document U.S. Pat. No. 10,597,952 B2 describes an upper interface for a submarine riser on an offshore floating vessel that has an upper funnel and a coaxial lower funnel in a spaced relation. Tensile loads in the riser are received in the upper funnel, while lateral and bending loads are received in the lower funnel. The riser upper interface can be used with flexible risers or steel catenary risers. However, the document does not disclose a suitable structure to be used with a deflector assembly positioned on the upper balcony, which allows lateral and angular adaptation of the pull-in cables.

Document U.S. Pat. No. 10,309,161 B2 refers to riser connector locking systems in oil production units. The document provides an autonomous riser support locking system, the system comprising a riser support connected at its lower end to a submerged riser and at its upper end to a traction member, a support balcony comprising a through opening through of which the traction element and at least part of the riser support pass through, a locking device positioned on the support balcony, the locking device being sliding with respect to the support balcony and driven by a drive means, wherein the locking device is slidable between an unlocking position and a locking position over the through opening, wherein, in the locking position, the locking device is lockingly engageable to a connector of the riser support after the connector has passed through the through opening of the support balcony. The document further provides an autonomous riser support locking method associated with the system described above. However, said document fails to propose an adequate system for aligning and adjusting pull-in cables, as well as means for lateral displacement and means for rotating a deflector assembly around its own axis. Consequently, the constructive configuration presented in document U.S. Pat. No. 10,309,161 B2 does not allow an LRB with two layers for the use of rigid and flexible type risers.

BRIEF DESCRIPTION OF THE INVENTION

In general, the present invention describes a pull-in system and method for keelhauling of rigid risers using a deflector device (pulley, track, roller track, among others) for the main pull-in cable and a Support Tube on a double-layer balcony.

The system comprising the deflector device aims at promoting the centralization of the main pull-in cable with the orientation of the Support Tube (top angle and azimuth), minimizing contact through sliding between the main pull-in cable and the Support Tube structure.

Furthermore, the system comprising the deflector device also aims at enabling the positioning of the Support Tube in the second (outermost) layer on a Lower Riser Balcony—LRB, thus allowing to maintain the I-Tubes/Bell mouths in the first (innermost) layer as an alternative connection of flexible risers in the respective pipe applications.

In this way, the intended system would circumvent, in future FPSOs projects and applications, the limitations related to keelhauling operations still present in some FPSOs, further allowing market competition between rigid and flexible pipelines.

Accordingly, this invention achieves its objectives by providing a pull-in cable deflector system in keelhauling of rigid risers comprising: a deflector assembly that includes a deflector device housed in a structural block, a sliding structure, and at least two rails. The structural block is slidably mounted on a base frame by means of a system of sliding supports to perform a first adjustment of the transverse distance from the deflector device to the URB.

Furthermore, the present invention also describes a pull-in method in keelhauling of rigid risers using a deflector device and a double-layer Support Tube, wherein the method comprises: taking the deflector device assembly to the position of the riser to be installed, performing a first adjustment of the transverse distance of the deflector device housed in a structural block to an upper riser balcony (URB), until the device reaches a position in the Support Tube orientation plane, locking the structural block to a base frame, in response to having reached the position in the orientation plane of the Support Tube, rotating the deflector device around its vertical center line, depending on the azimuth of the Support Tube, and performing a second adjustment of the transverse distance of the deflector device during the pull-in operation.

As advantages of the system and method of the invention, it should be noted that they provide greater flexibility in the field underwater arrangement, allowing the positioning of an FPSO with wells on the starboard side, or alternatively on the port side, overcoming the physical limitations to the method of pull-in in rigid risers via keelhauling operations, further enabling the use of flexible risers as an alternative to rigid risers in the respective interconnections, maintaining the premise of market competition between rigid and flexible pipes.

BRIEF DESCRIPTION OF THE FIGURES

The brief description above, as well as the detailed description below, of the preferred embodiments of the invention in question, will be better understood when read together with the attached drawings. For the purpose of illustrating the present invention, embodiments thereof are shown in the drawings. It must be understood, however, that the invention is not limited only to the precise arrangements and instruments shown.

Thus, the present invention will be described below with reference to its typical embodiments and with reference to the attached drawings, in which.

DETAILED DESCRIPTION

In the following, reference is made in detail to the preferred embodiments of the present invention illustrated in the attached drawings. Whenever possible, the same reference numbers or similar will be used throughout the figures to refer to the same or similar features. It should be noted that the drawings are in simplified form and are not to precise scale, so slight variations are anticipated.

Figure 1A:
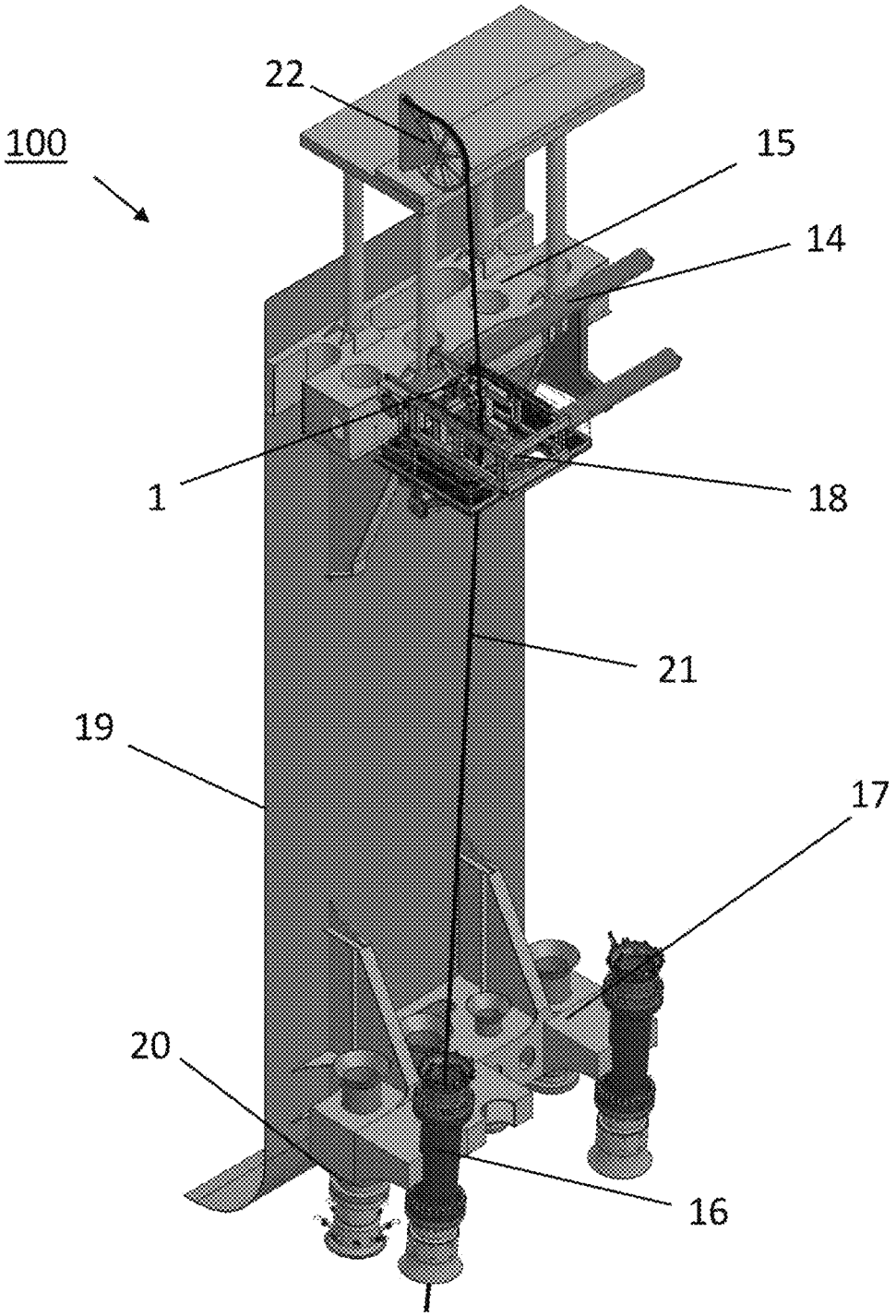
FIG. 1A shows a perspective view of a pull-in cable deflector system for keelhauling of rigid risers through support tube on a double-layer lower riser balcony, in accordance with an exemplary configuration of the present invention.
Figure 1B:
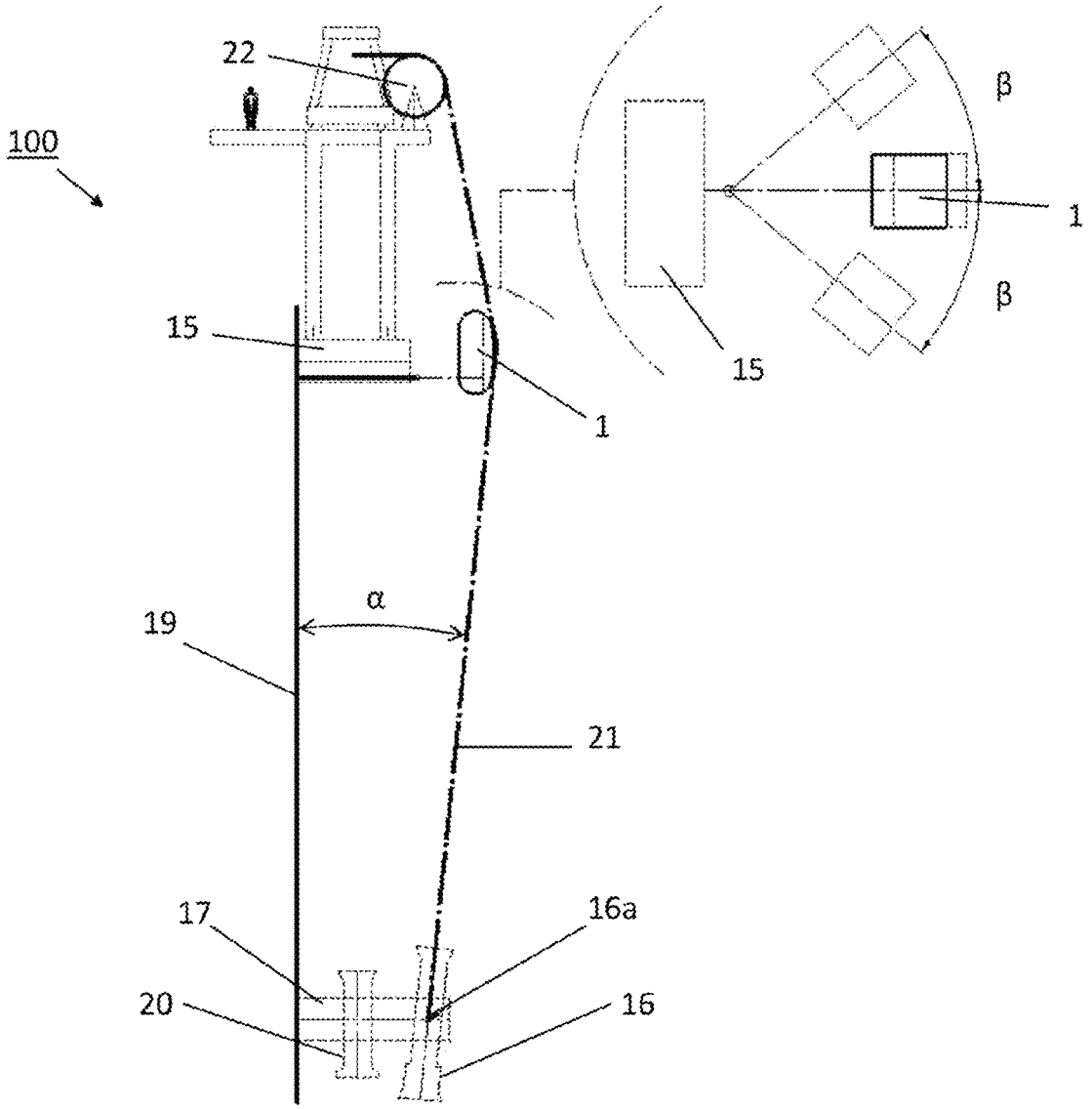
FIG. 1B shows an indicative general representation of the pull-in cable deflector system for keelhauling of rigid risers through support tube on a double-layer lower riser balcony, in accordance with an exemplary configuration of the present invention.

FIGS. 1A and 1B depict a pull-in cable deflector system (100) for keelhauling operations of rigid risers through a support tube on a double-layer lower riser balcony (LRB), wherein the system (100) is applied to an FPSO-type platform or vessel. However, the application of the system described by the present invention is not limited to application on an FPSO-type platform.

As seen in FIGS. 1A and 1B, a pull-in cable (21) passes through a support tube (16) towards a sheave (22) pulled by a main winch (not shown) positioned on the FPSO (19).

The pull-in cable deflector system (100), according to FIGS. 1A and 1B, comprises: a deflector assembly (18) that includes a deflector device (1), a sliding structure (11), and rails (14).

Riser balconies are SPU items, independent of the invention system presented here. Thus, the deflector device of this invention comprises all items except the balconies. The system of the present invention makes it possible, among other things, to use the double balcony in two support layers, for the keelhauling configuration.

In particular, the LRB (17) has a double-layer configuration, wherein the first (innermost) layer is configured to receive I-tubes and bell mouths (20). On the other hand, the second (outermost) layer of the LRB (17) is configured to receive at least one support tube (16).

According to FIGS. 2, 3A, 3B and 3C, the deflector assembly (18) comprises a deflector device (1) housed in a structural block (2) with its driving mechanisms. As seen by way of example in FIG. 4, the deflector device (1) is a pulley or semi-pulley, with a movable belt of "U" shoes, containing openings (1*a*) to fit and house the structural block (2). The deflector device (1) may also be a roller track, deflector track, or use any other low-friction steel cable deflector device suitable for the application.

Figure 5:
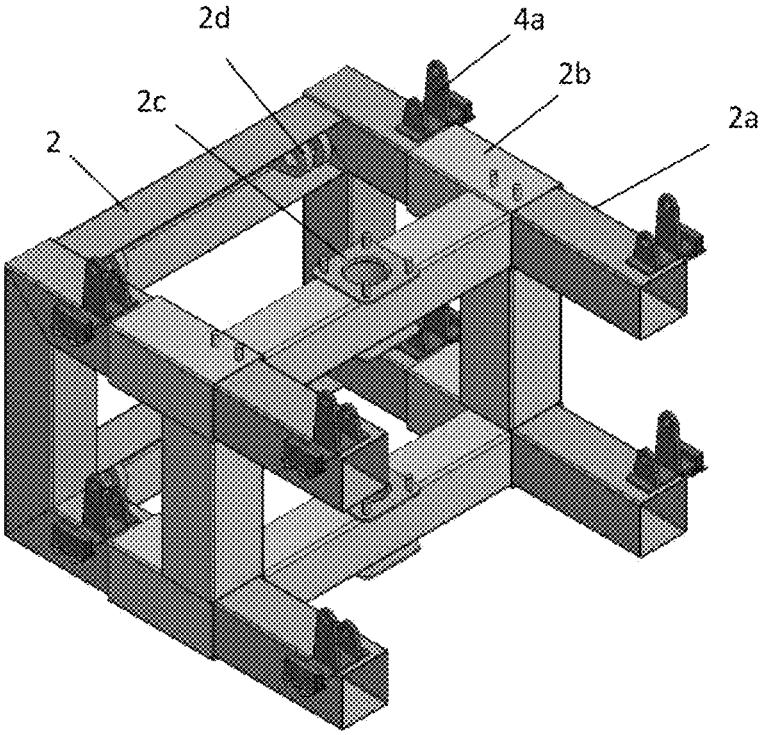
FIG. 5 shows a structural block of the pull-in cable deflector system, according to an exemplary configuration of the present invention.

The deflector assembly (18) further comprises a structural block (2), as seen in detail in FIG. 5, which includes an internal part (2*a*), an external part (2*b*) and connection elements (2*c*) arranged in the central region of the external part (2*b*) to connect with the openings (1*a*) of the deflector device (1).

Figure 6:
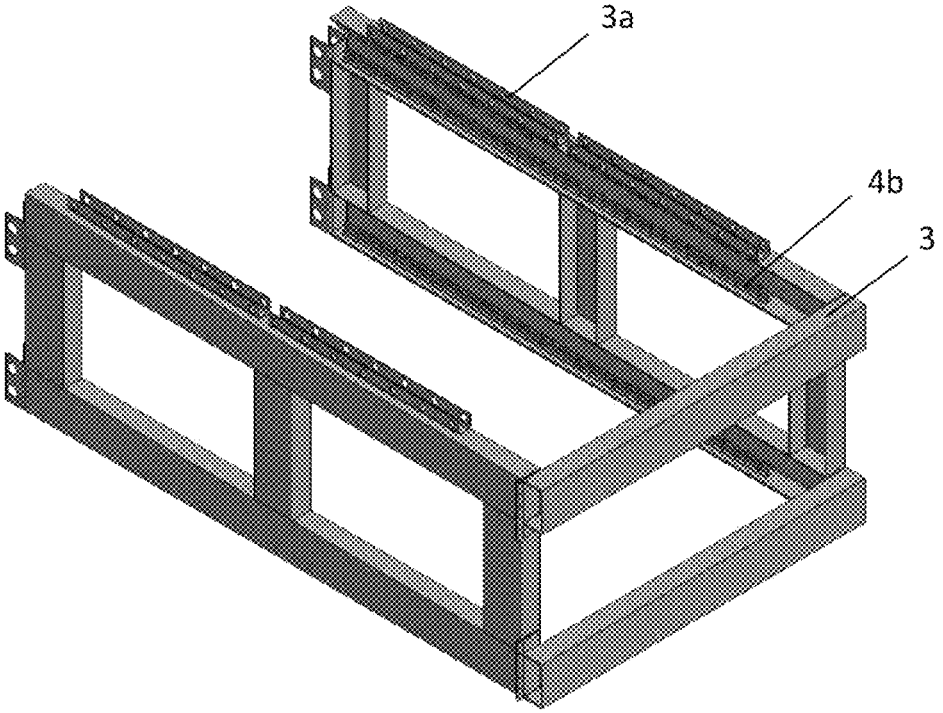
FIG. 6 presents a base frame of the pull-in cable deflector system, according to an exemplary configuration of the present invention.
Figure 7:
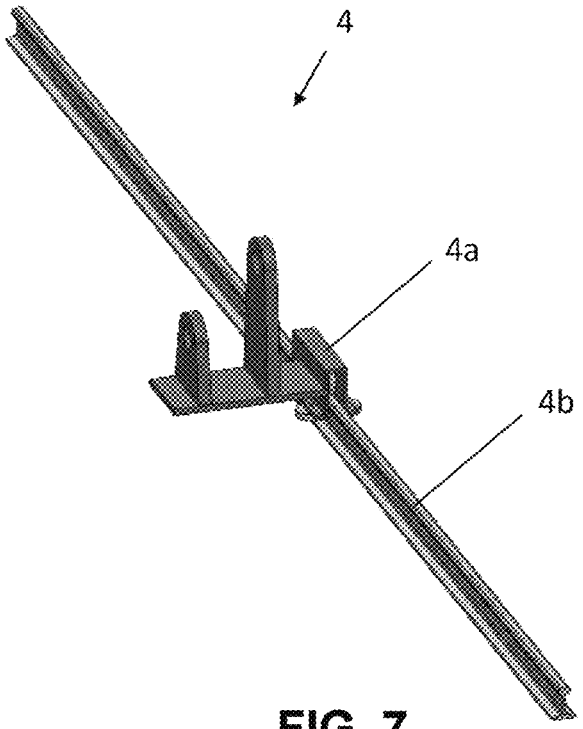
FIG. 7 shows a sliding support system, according to an exemplary configuration of the present invention.

Furthermore, the structural block (2) is mounted on a base frame (3), as shown in FIG. 6, wherein the base frame (3) comprises locking fitting profiles (3*a*) fixed to the upper surface of its upper sidebars. More specifically, the structural block (2) is slidably mounted on the base frame (3) by means of a sliding support system (4), as shown in FIG. 7. The sliding support system (4) includes at least one fixing support (4*a*) attached to the structural block (2) and slidably mounted on at least one rail (4*b*), using sheaves or other suitable means for displacement, wherein at least one rail (4*b*) is fixed to the base frame (3). Furthermore, it should be noted that each sliding support system (4) may comprise, for each rail (4*b*), one or more fixing supports (4*a*); preferably, two supports (4*a*), but not limited to a specific number, which will depend on the length of the structural block (2) to be mounted on the base frame (3).

The assembly of the structural block (2) on the base frame (3) on sliding supports (4) is essential for a first adjustment of the transverse distance of the deflector device (1) to the URB (15), aiming at positioning the device (1) in the orientation plane of the support tube (16) and defining an installation angle ($\alpha$) between the FPSO (19) and the pull-in cable (21) from an inclination of the support tube (16) around from its center of rotation (16*a*), as seen schematically in FIG. 1B.

Figure 2:
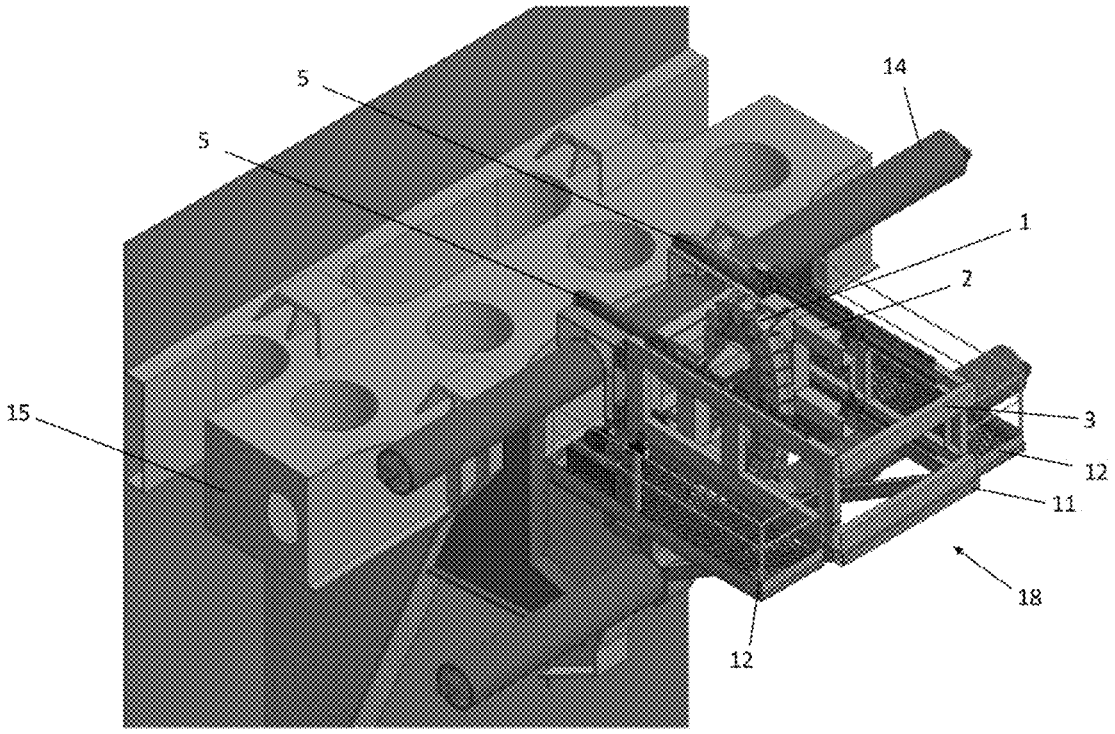
FIG. 2 shows a perspective view of the deflector assembly connected to the upper riser balcony via rails, according to an exemplary configuration of the present invention.
Figure 3A:
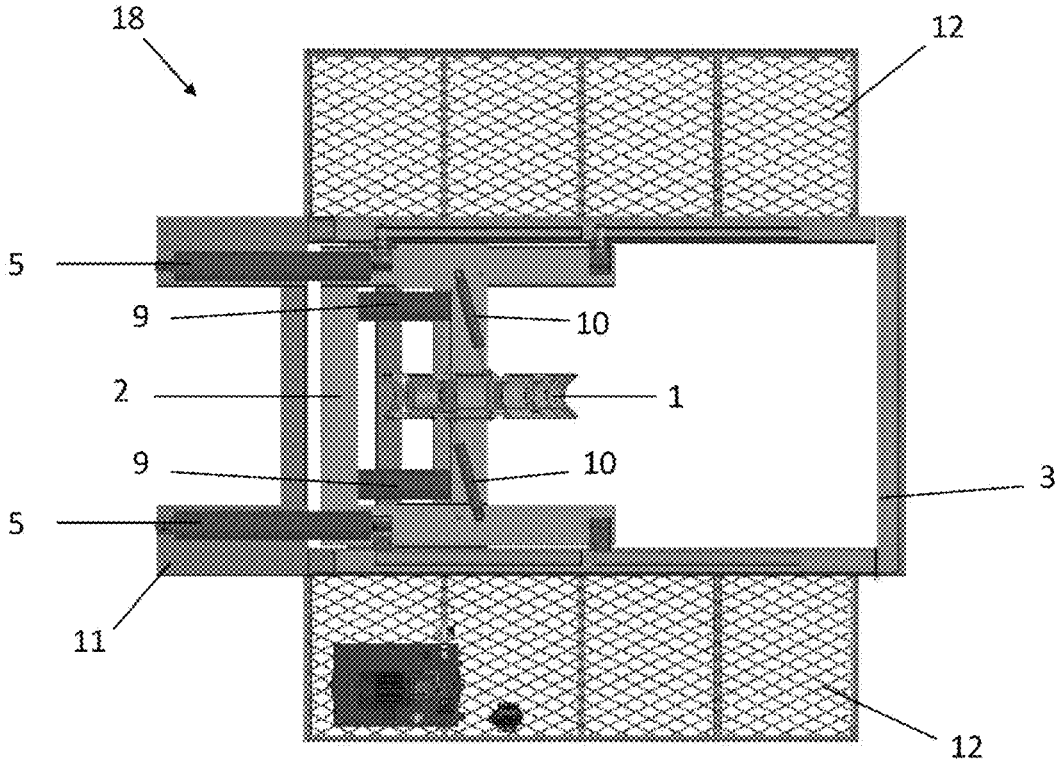
FIG. 3A presents a top view of the deflector assembly, in a retracted position, according to an exemplary configuration of the present invention.
Figure 3B:
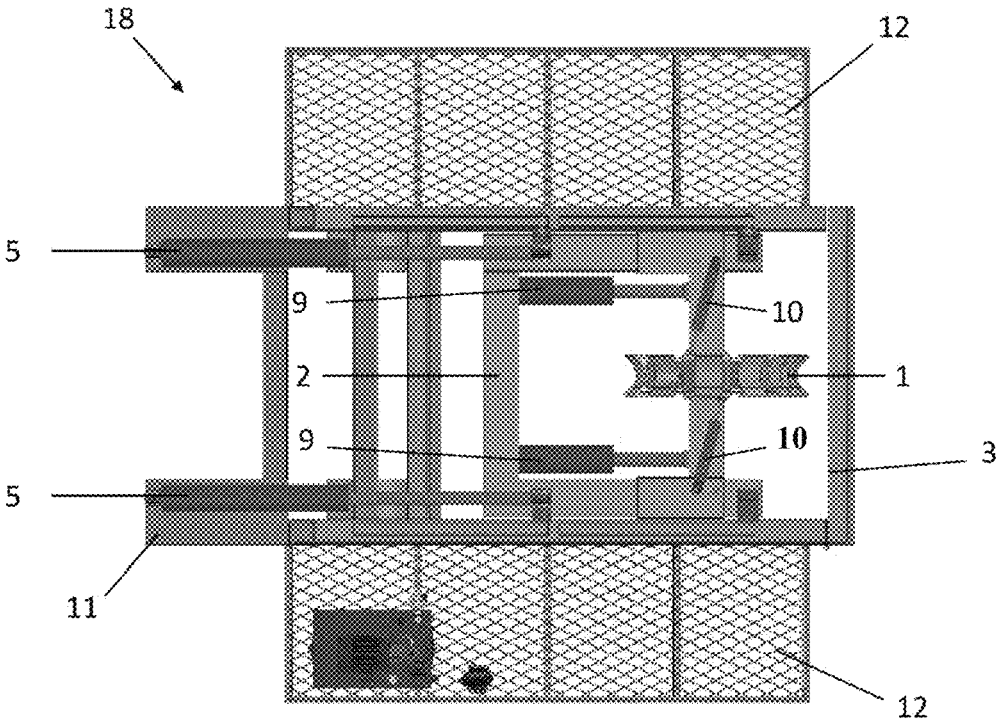
FIG. 3B presents a top view of the deflector assembly, in an extended position, according to an exemplary configuration of the present invention.
Figure 4:
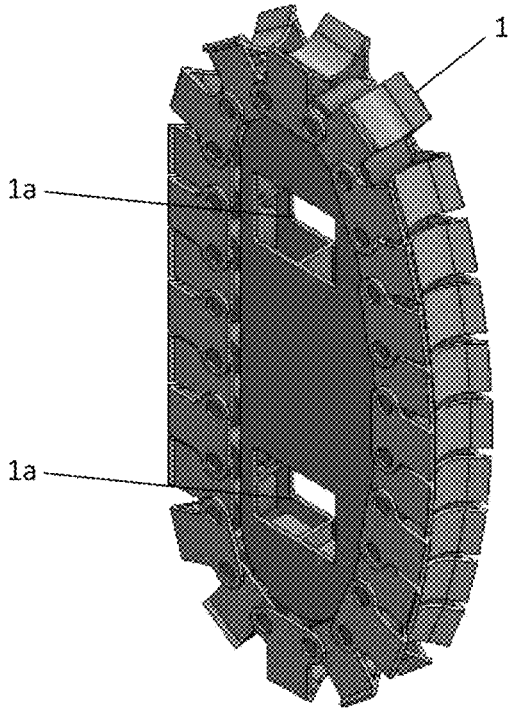
FIG. 4 presents a deflector device of the pull-in cable deflector system, according to an exemplary configuration of the present invention.
Figure 8A:
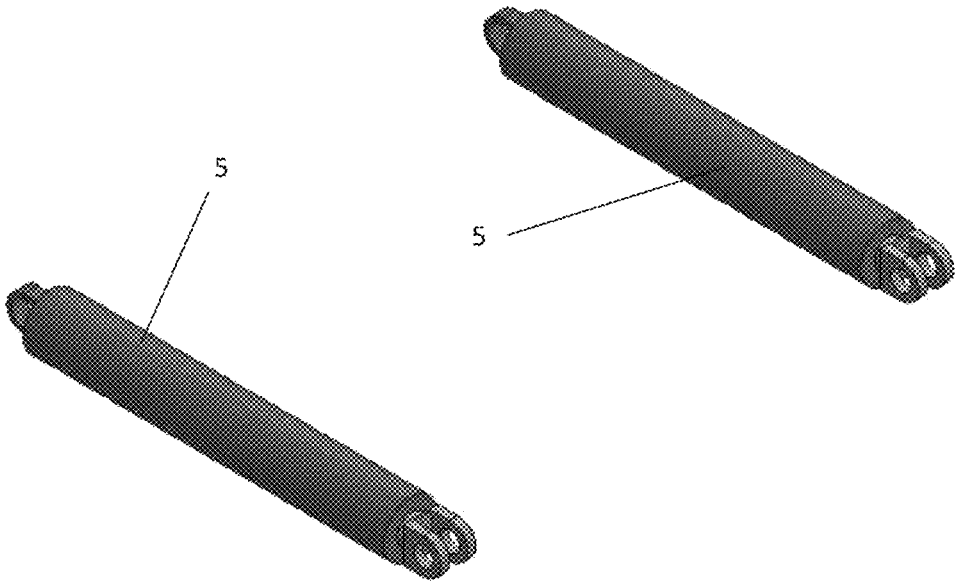
FIG. 8A shows a set of low capacity hydraulic cylinders, according to an exemplary configuration of the present invention.
Figure 8B:
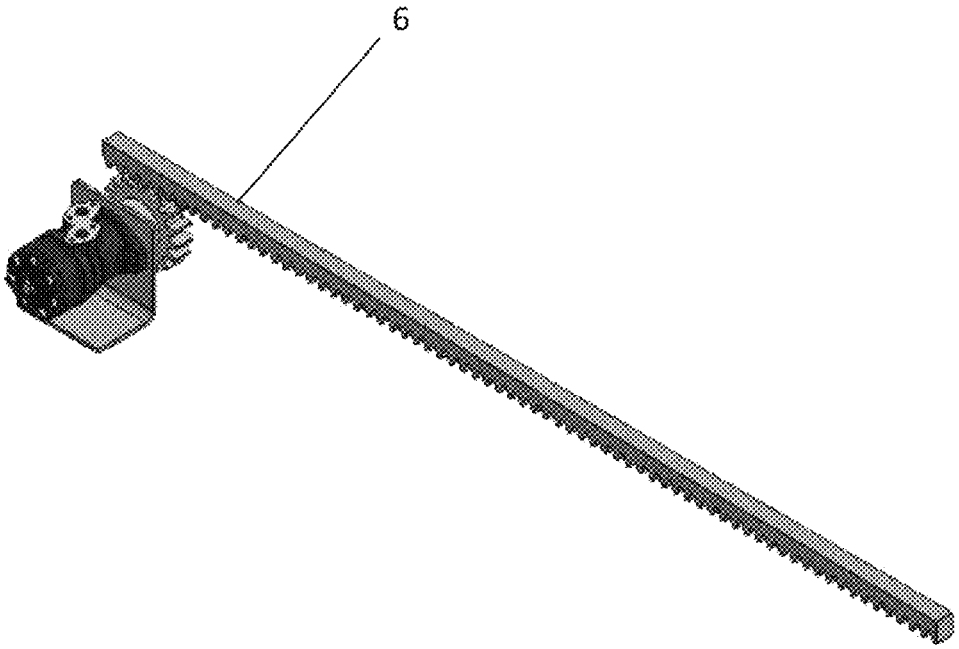
FIG. 8B presents a rack-pinion system, according to an exemplary configuration of the present invention.

This first transverse distance is defined as "passive extension adjustment" and will be better described based on FIGS. 2, 3A and 3B, according to an embodiment of the present invention. In this way, the passive adjustment is carried out by at least two low capacity hydraulic cylinders (5) which are attached to the sliding structure ("trolley") (11) and extend forward moving the structural block (2) comprising the deflector device (1) from a retracted position to an extended position, as shown in FIGS. 3A and 3B, respectively. Alternatively, the passive adjustment can also be carried out by a rack-pinion system (6) driven by an electric or hydraulic motor. However, it should be noted that the present invention is not limited to these movement mechanisms. The low capacity hydraulic cylinders (5) and the rack-pinion system (6) can be seen, respectively, in FIGS. 8A and 8B.

Figure 9:
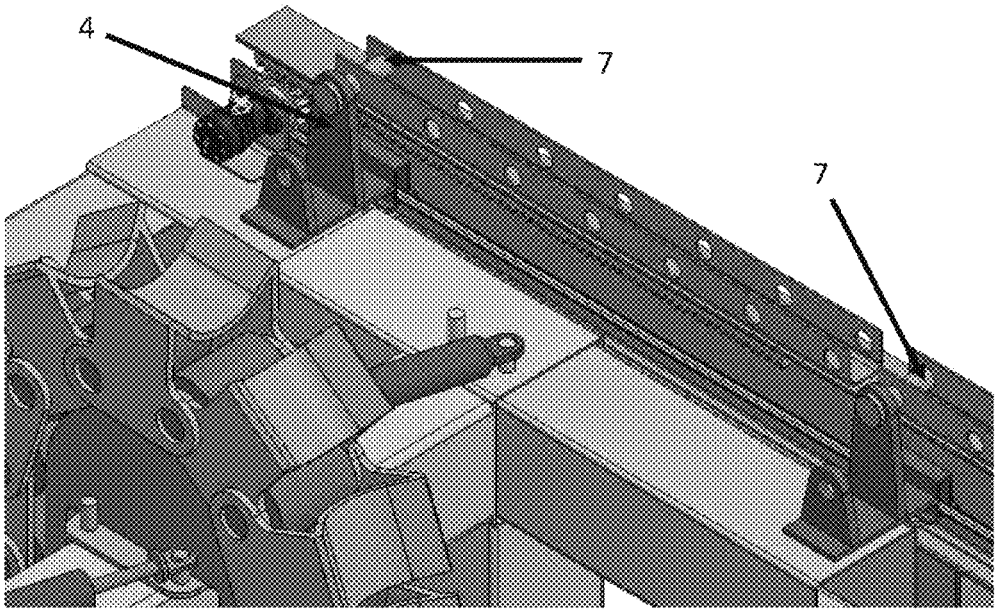
FIG. 9 shows a highlighted view of the mechanical locking carried out between the structural block and the base assembly, according to an exemplary configuration of the present invention.

Subsequently, the structural block (2) is anchored to the base frame (3) in different operating positions (associated with the azimuth, top angle, and projection of the Support Tube) by mechanically locking the sliding support system (4) into the locking fitting profiles (3*a*) of the base frame (3). The mechanical locking, as demonstrated in greater detail in FIG. 9, can be carried out using latches or pins (7) or any other means of fixing suitable for the project.

Figure 10:
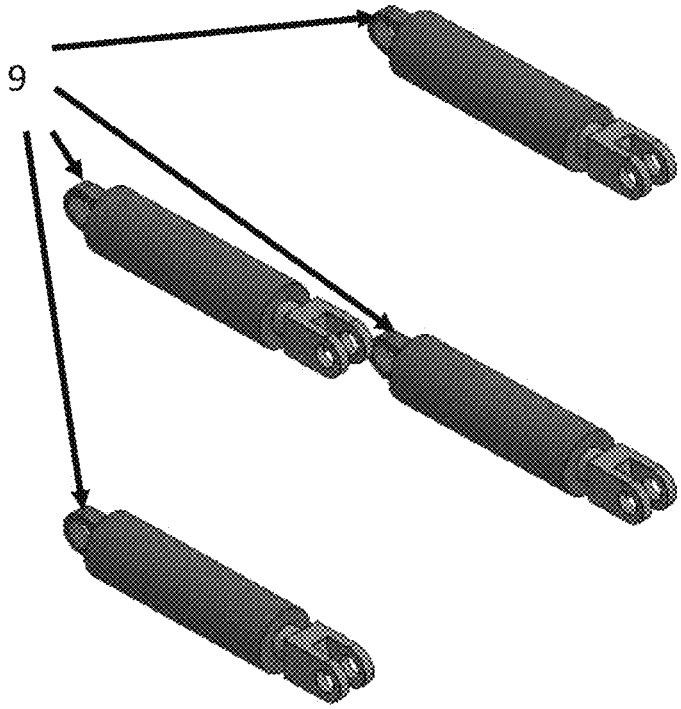
FIG. 10 shows a set of high capacity hydraulic cylinders, according to an exemplary configuration of the present invention.

After performing the passive extension adjustment, the "active extension adjustment" occurs. The active extension adjustment is obtained through the configuration of the structural block (2) in a telescopic system, provided by the fit between the internal part (2*a*) and the external part (2*b*) of the block (2), which are movable one in relation to the other, and the action of high capacity hydraulic cylinders (9), which are attached to the internal part (2*a*) in a fitting portion (2*d*) and act as a block, but are not limited to this system, to displace the external part (2*b*). This additional configuration of the structural block (2) allows a continuous final adjustment of extension or retraction of the transverse position of the deflector device (1) during pull-in. It should be noted that, in a preferred embodiment of the present invention, active adjustment is performed by up to four high-capacity hydraulic cylinders (9), as shown in FIG. 10. However, in alternative embodiments, at least two cylinders (9) or even more than four cylinders (9) can be used. Furthermore, it should be noted that the high-capacity hydraulic cylinders (9) can be driving during the pull-in, if necessary.

Figure 3C:
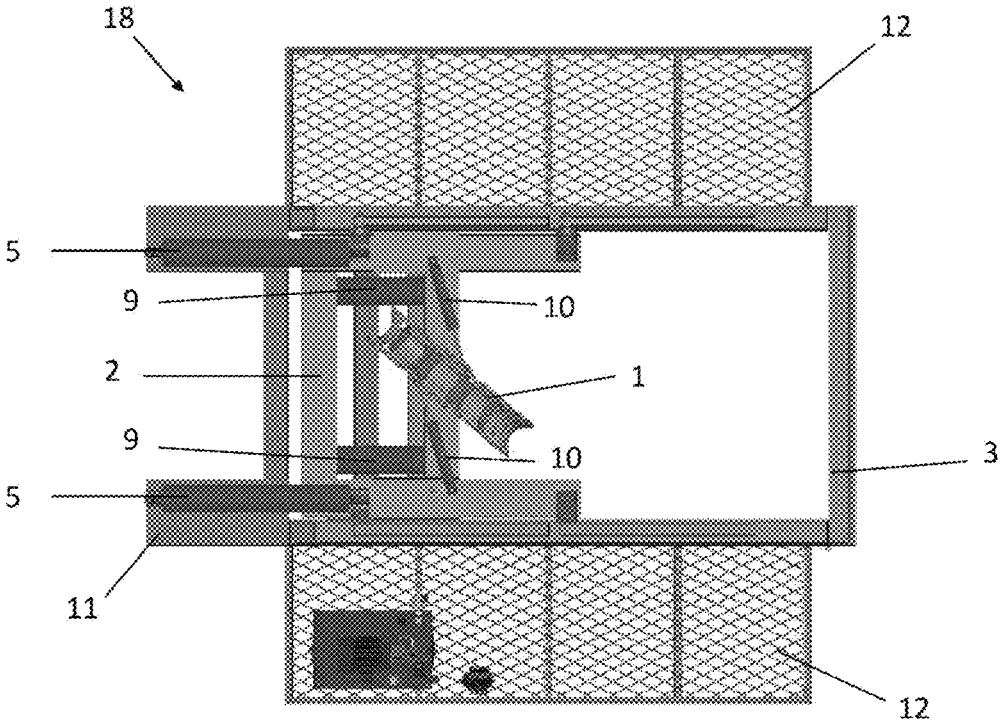
FIG. 3C presents a top view of the deflector assembly, in a retracted position, highlighting the rotation of the deflector device around its own axis, according to an exemplary configuration of the present invention.

Referring to FIG. 3C, an additional adjustment of the deflector device (1) is described. In particular, the deflector device (1), according to an exemplary embodiment of the present invention, is configured to rotate or pivot around a geometric axis of rotation represented by its vertical center line. This rotation sweeps through an angle (β), up to approximately 40° clockwise, or up to approximately 40° counterclockwise, as shown schematically in FIG. 1B.

Figure 11:
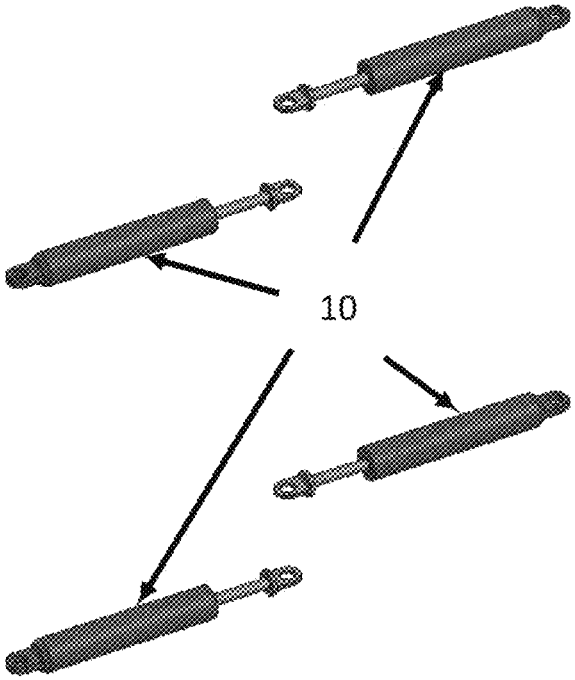
FIG. 11 shows a set of low capacity hydraulic cylinders, according to an exemplary configuration of the present invention.

Furthermore, this additional rotation around the vertical axis of the deflector device (1) for the pull-in or pull-out direction corresponds to the azimuth of the support tube (16) and does not require adjustment during operation, so that it is carried out using smaller capacity hydraulic cylinders (10), as shown in FIG. 11, attached to the external part (2*b*) of the structural block (2) and arranged on the sides of the deflector device (1). The hydraulic cylinders (10) are attached to the external part (2*b*) of the block (2) and to the connecting element of the deflector device (2*c*) with a lock pin to rigidly fix the deflector device (1) to its structural block (2). Alternatively to cylinders, a gear system can be used, but this is not limited to these systems.

Figure 12:
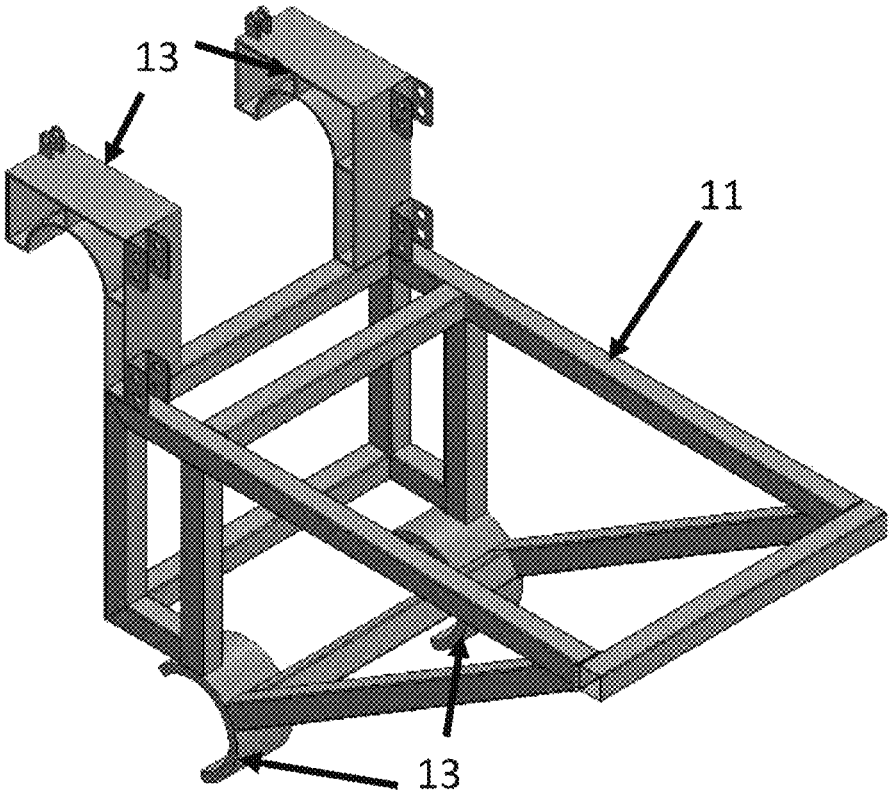
FIG. 12 presents a sliding structure, according to an exemplary configuration of the present invention.

According to an additional and preferred embodiment of the present invention shown by FIGS. 1A, 2, 3A, 3B and 3C, the deflector assembly (18) is arranged on a sliding structure (11). FIG. 12 highlights the sliding structure (trolley) (11) which comprises four sliding support regions (13). In particular, the base frame (3) connected to the structural block (2) of the deflector assembly (18) is supported by the sliding structure (11). The sliding structure (11) preferably comprises access platforms (12) connected to the sides of the structure (11) to allow safe access to both the base frame (3) and the structural block (2) of the deflector device (1), notably to perform the initial passive configuration adjustments of the system, in preparation for the pull-in.

Figure 13:
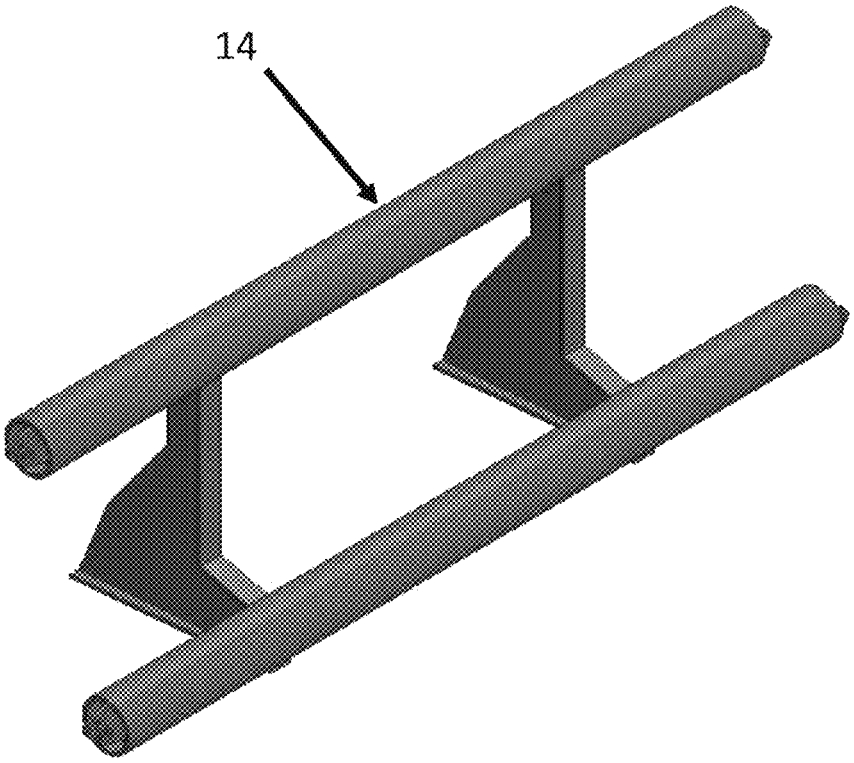
FIG. 13 presents a set of rails, according to an exemplary configuration of the present invention.

Additionally, the sliding structure (11) can be connected by means of its supports (13) in a sliding manner to at least two longitudinal rails (14), as seen in FIGS. 1A, 2 and, in greater detail, in FIG. 13, installed forward of the URB (15) and attached to its foundation. It should be noted that the rails (14) allow the system to be moved along the URB (15) to different pull-in/pull-out positions when keelhauling rigid risers, therefore providing additional adjustment to the set.

Furthermore, according to an additional and preferred embodiment, the system (100) comprises, in its lower portion, at least one support tube (16) structurally connected to the LRB (17) in its outermost layer (second layer), thus preserving the innermost layer (first layer) for the installation of other types of support devices, such as I-tubes and bell mouths (20) to support risers or flexible ducts.

In accordance with the preferred and optional embodiments of the present invention, described above based on the system and its constituent elements, the present invention also provides a method of pull-in in keelhauling of rigid risers using deflector device and double layer Support Tube comprising: performing a first adjustment of the transverse distance of the deflector device (1) housed in a structural block (2) to an upper riser balcony (URB) (15) until the device (1) reaches a position in the orientation plane of the support tube (16), wherein the position is a function of the azimuth, top angle and projection of the tube (16), locking the structural block (2) to a base frame (3), in response to having reached the position in the orientation plane of the support tube (16), rotating the deflector device (1) around its vertical center line, depending on the azimuth of the Support Tube, performing a second adjustment of the transverse distance of the deflector device (1) during the pull-in operation.

Additionally, the method may further comprise: moving the base frame (3), through a sliding structure (11) on rails (14) installed forward of the URB (15) to the different pull-in or pull-out positions in keelhauling of rigid risers.

Therefore, based on what was previously described, the deflector device (1) positioned forward of the URB (15) has the function of guiding the exit direction of the pull-in cable with the position and orientation of the at least one support tube (16) in the LRB (17) during the connections of the rigid risers that approach from starboard (in keelhauling) at the second end of the LRB (17). This configuration eliminates the current interference restrictions of the pull-in cable (21) and the pull-in equipment with the supports during the movement of the riser by the FPSO's main winch (19). At the same time, the pull-in configuration that would be obtained with the use of this deflector device (1) would result in greater clearance between the Support Tube and the FPSO hull (19), which would make a double layer LRB arrangement viable (17) also for keelhauling positions, without the need for significant structural and architectural changes in the design of an FPSO (19).

Thus, it is important to note that the pull-in system of the present invention consists of a deflector assembly comprising a pull-in cable deflector device housed in a structural block, wherein the device may be a moving belt, a semi-pulley, a roller track, or any other suitable device, with rotation driven by friction with the pull-in cable. Furthermore, its position on the launch plane—transversal to the URB—can be extended or retracted to accommodate different installation angles, through the action of hydraulic cylinders, hydraulic motors, electric motors, levers, among other components. The deflector system also has a turning mechanism on the device own axis for orientation in the directions of the risers on the starboard side or, optionally, on the port side, depending on the pull-in conditions to be performed. Finally, the deflector assembly of the present invention can be integrated into the side of the URB by a continuous tubular rail, which allows it to be moved to different pull-in or pullout positions.

Those skilled in the art will value the knowledge presented herein and will be able to reproduce the invention in the presented embodiments and in other variants, encompassed by the scope of the attached claims.

The invention claimed is:

1. A pull-in cable deflector system comprising:

a base frame;

a structural block movably mounted on the base frame, the structural block configured to move along a first axis between a retracted position and an extended position along the base frame;

a deflector device housed within the structural block, the deflector device configured to engage with a pull-in cable;

a sliding support connected to the base frame; and at least one rail connected to a riser balcony of an off-shore production system, wherein the sliding support is configured to move along the at least one rail to position the base frame along the off-shore production system.

2. The system of claim 1, wherein the deflector device is a pulley or a roller track.

3. The system of claim 1, further comprising a support tube connected to the pull-in cable, the support tube configured to connect to a riser of an off-shore production system.

4. The system of claim 3, further comprising a movement system configured to move the structural block between the retracted position and the extended position based on an azimuth, top angle, or projection of the support tube.

5. The system of claim 1, wherein the base frame comprises one or more rails, and wherein the structural block is movably connected to the one or more rails.

6. The system of claim 5, further comprising a deflector device mount configured to connect to the deflector device.

7. The system of claim 6, wherein the structural block comprises one or more rails, and wherein the deflector device mount is movably connected to the one or more rails of the structural block.

8. The system of claim 7, wherein the deflector device mount is configured to be positioned along the one or more rails of the structural block based on an azimuth, top angle, or projection of a support tube.

9. The system of claim 1, wherein the structural block comprises at least one rotation device configured to rotate the deflector device around a second axis which is perpendicular to the first axis.

10. The system of claim 9, wherein the rotation device is configured to rotate the deflector device up to 40° in a clockwise or counterclockwise direction from a center position around the second axis.

11. The system of claim 1, wherein the base frame comprises a lock fitting profile fixed to an upper surface of the base frame, the lock fitting profile configured to engage with a fixing support of the structural block, thereby preventing at least a portion of the structural block from moving in relation to base frame.

12. The system of claim 11, wherein the fixing support is configured to engage with the lock fitting profile in a plurality of configurations thereby securing the structural block to the base frame in a plurality of positions along the base frame, each of the plurality of configurations corresponding to a different position of the plurality of positions.

13. A method of pulling a riser, the method comprising:

positioning a structural block along a first axis such that a deflector device housed within the structural block is in an orientation plane of a support tube, the structural block comprising a deflector device mount and one or more rails;

locking the one or more rails of the structural block to a base frame after the deflector device is positioned in the orientation plane of the support tube;

rotating the deflector device around a second axis perpendicular to the first axis based on an azimuth of the support tube; and moving the deflector device mount along the one or more rails.

14. The method of claim 13, further comprising moving a sliding structure connected to the base frame along at least one rail connected to a balcony of an off-shore production system.

15. The method of claim 13, wherein positioning the structural block such that a deflector device housed within the structural block is an orientation plane of a support tube is based on the azimuth, top angle, or projection of the support tube, or any combination thereof.

16. The method of claim 13, wherein adjusting the horizontal position of the deflector device relative to the internal part of the structural block, via the movement of an external part of the structural block along the length of the internal part is accomplished periodically during a pull-in operation.

17. The method of claim 13, rotating the deflector device around a second axis perpendicular to the first axis of the deflector device comprises rotating the deflector device up to 40° in the clockwise or counterclockwise direction from a center position around the second axis.

18. The method of claim 13, further comprising supporting, by the deflector device, pull-in cable, the pull-in cable connected to a pulley drive and a riser of an off-shore production system.

19. The method of claim 18, further comprising:

pulling the riser via the pull-in cable; and connecting the riser to a support tube.

20. A pull-in cable deflector system comprising:

a base frame comprising a lock fitting profile fixed to an upper surface of the base frame;

a structural block movably mounted on the base frame, the structural block configured to move along a first axis between a retracted position and an extended position along the base frame, wherein the lock fitting profile is configured to engage with a fixing support of the structural block, thereby preventing at least a portion of the structural block from moving in relation to base frame; and a deflector device housed within the structural block, the deflector device configured to engage with a pull-in cable.

* * * * *